US009393616B2

(12) United States Patent
Tockert et al.

(10) Patent No.: US 9,393,616 B2
(45) Date of Patent: Jul. 19, 2016

(54) SPREADING DEVICE FOR BULK MATERIAL ON A CIRCULAR SURFACE AND METHOD FOR OPERATING THE SAME

(71) Applicant: PAUL WURTH S.A., Luxembourg (LU)

(72) Inventors: Paul Tockert, Bergbourg (LU); Emile Lonardi, Bascharage (LU); Serge Devillet, Grevenmacher (LU); Stefan Schons, Tawern (DE)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 14/648,407

(22) PCT Filed: Nov. 11, 2013

(86) PCT No.: PCT/EP2013/073458

§ 371 (c)(1),
(2) Date: May 29, 2015

(87) PCT Pub. No.: WO2014/082842

PCT Pub. Date: Jun. 5, 2014

(65) Prior Publication Data

US 2015/0306662 A1 Oct. 29, 2015

(30) Foreign Application Priority Data

Nov. 29, 2012 (LU) ..... 92107

(51) Int. Cl.
*B22D 11/108* (2006.01)
*B22D 11/111* (2006.01)
(Continued)

(52) U.S. Cl.
CPC *B22D 27/00* (2013.01); *B22D 1/00* (2013.01); *B22D 11/108* (2013.01);
(Continued)

(58) Field of Classification Search
CPC ..... B22D 1/00; B22D 27/00
USPC ..... 164/55.1, 268, 473; 266/216
See application file for complete search history.

(56) References Cited

U.S. PATENT DOCUMENTS 4,408,750 A * 10/1983 Andersson ..... B05B 7/1486 266/216
5,143,682 A * 9/1992 Dhuyvetters ..... B22D 11/108 164/268

FOREIGN PATENT DOCUMENTS

CN 201900240 U 7/2011
EP 0059411 A1 9/1982
(Continued)

OTHER PUBLICATIONS

International Search Report and Written Opinion issued Jun. 3, 2014 re: Application No. PCT/EP2013/073458.
Korean Office Action issued Jul. 8, 2015 re: Application No. 10-2015-7014406; pp. 1-7.

*Primary Examiner* — Kevin E Yoon
(74) *Attorney, Agent, or Firm* — Cantor Colburn LLP

(57) ABSTRACT

A spreading device (10) for the spreading of bulk material on a circular surface comprises a distribution plate (12) mounted about a central shaft (14); at least one radially extending slit (16) arranged in the distribution plate (12); and a scraper device (24) for spreading the bulk material over the length of the slit (16). The bulk material is preferably granular or powdered covering material to be deposited as an insulation layer on the top layer of a casting mold containing molten steel or metal. According to the present invention, a rectangular distribution trough (22) mounted on the distribution plate (12), the slit (16) being arranged within the distribution trough (22). Furthermore, a feed pipe (30) is arranged so as to feed bulk material into the distribution trough (22) onto an area corresponding to the rotational center (18) of the distribution plate. The slit (16) extends from the rotational center (18) of the distribution plate (12) to the edge (20) thereof. Finally, the scraper device (24) comprises at least one linearly displaceable scraper (28) arranged within the distribution trough (22) so as to feed the bulk material through the distribution trough (22) radially outwards from the rotational center (18) of the distribution plate (12). The invention also relates to a method for applying a homogeneous layer of material onto a circular surface by using such a spreading device (10).

15 Claims, 3 Drawing Sheets

(51) Int. Cl.

| | |
|---|---|
| ***B22D 27/00*** | (2006.01) |
| ***C21C 7/00*** | (2006.01) |
| ***F27D 3/00*** | (2006.01) |
| ***B22D 1/00*** | (2006.01) |
| ***B22D 45/00*** | (2006.01) |
| ***C22B 9/10*** | (2006.01) |

(52) U.S. Cl.
CPC ..... *B22D 11/111* (2013.01); *B22D 45/00* (2013.01); *C21C 7/0006* (2013.01); *C21C 7/0075* (2013.01); *C22B 9/103* (2013.01); *F27D 3/0033* (2013.01)

(56) References Cited

FOREIGN PATENT DOCUMENTS

| | | | |
|---|---|---|---|
| EP | 0171220 | A1 | 2/1986 |
| EP | 0389918 | A1 | 10/1990 |
| EP | 0846507 | A1 | 6/1998 |
| JP | 6284858 | A | 4/1987 |
| JP | 06034856 | U | 5/1994 |
| JP | 11285604 | A | 10/1999 |
| KR | 1020030012354 | A | 2/2003 |
| KR | 1020100046483 | A | 5/2010 |
| KR | 20110034476 | A | 4/2011 |
| KR | 20110046671 | A | 5/2011 |

* cited by examiner

SPREADING DEVICE FOR BULK MATERIAL ON A CIRCULAR SURFACE AND METHOD FOR OPERATING THE SAME

TECHNICAL FIELD

The present invention generally relates to a device for the uniform spreading of bulk material on a circular surface, in particular of granular or powdered covering material on the top layer of a casting mold or casting ladle containing molten steel or metal, in order to achieve a homogeneous, protective and insulating covering layer. The invention is particularly intended for preventing heat losses in casting ladles and steel casting molds. The insulating layer also serves to prevent adverse elements in the surrounding air from combining with molten steel.

BACKGROUND ART

In order to avoid heat losses through radiation, it is known to place a granular covering material on the top layer of a casting mold or ladle. The material used may be sawdust, glass, sodium silicate or Vermiculite. Recovered material such as aluminum oxide ($Al_2O_3$), calcium oxide (CaO) or aluminum drops may also be used.

While the pouring of granular or powdered material onto the top layer of a casting ladle was initially carried out in a rather rough fashion by means of a hoisting mechanism and a chute, it was soon realized that it was necessary to find a more accurate solution. It is indeed desired to obtain accuracy in the metering of the desired quantity in order to obtain a predetermined layer thickness and also an even distribution of the bulk material over the whole surface to be covered.

An improved spreading device was suggested in EP 0 389 918, wherein the device comprises a fixed part from which a cover with scrapers is suspended, and a rotating part fitted below the scrapers. The rotating part comprises a series of slits that are uniformly distributed around a central shaft. The slits are radially widening in the direction away from the central shaft. Through the rotating movement of the rotating part and the levelling action of the fixed scrapers, the bulk material is uniformly distributed over the slits of the distribution bin. A rising and falling cover makes it possible to process varying volumes of bulk material.

While this device achieves a homogeneous, protective and insulating covering layer on the top layer of a casting ladle containing molten steel it also has a number of disadvantages. Indeed, due to the central shaft, no material can be deposited directly to the center of the surface to be covered. This problem may however be partially solved by the use of deflectors for the bulk material.

Another disadvantage of the device is that after each operation, the distribution bin must again be filled with bulk material, which may cause some delay between two filling operations. Such a delay may e.g. cause unnecessary cooling of the molten steel or metal contained in the next ladle to be covered.

Furthermore, it should also be noted that the construction of the device is rather cumbersome and necessitates a non-negligible amount of preventive and corrective maintenance work.

Although, the device of EP 0 389 918 provides a homogeneous layer on the top layer of a casting ladle containing molten steel, there is still room for improvement.

BRIEF SUMMARY

The invention provides an improved spreading device for applying a homogeneous layer of material onto a circular surface. The invention further provides a method for applying a homogeneous layer of material onto a circular surface.

A spreading device for the spreading of bulk material on a circular surface comprises a distribution plate rotatably mounted about a central shaft; at least one radially extending slit arranged in the distribution plate; and a scraper device for spreading the bulk material over the length of the slit. The bulk material is preferably granular or powdered covering material to be deposited as an insulation layer on the top layer of a casting mold containing molten steel or metal.

According to the present invention, a rectangular distribution trough mounted on the distribution plate, the slit being arranged within the distribution trough. Furthermore, a feed pipe is arranged so as to feed bulk material into the distribution trough onto an area corresponding to the rotational center of the distribution plate. The slit extends from the rotational center of the distribution plate to the edge thereof. Finally, the scraper device comprises at least one linearly displaceable scraper arranged within the distribution trough so as to feed the bulk material through the distribution trough radially outwards from the rotational center of the distribution plate.

Due to the bulk material being fed onto an area corresponding to the rotational center of the distribution plate and the slit extending from the rotational center to the edge of the distribution plate, material can be deposited onto the whole area of the molten metal in the ladle. Due to constructional constraints it was in prior art devices, EP 0 389 918 in particular, not possible to feed material to the center of the ladle.

The present spreading device thus allows depositing a homogeneous, protective and insulating covering layer onto the molten steel in a ladle. The present spreading device furthermore allows achieving such with less maintenance downtime than with prior art devices.

The scraper device advantageously comprises a linear conveyor with a plurality of scrapers mounted thereon, thereby achieving a faster and more uniform spread of bulk material over the length of the slit.

In order to obtain homogeneous covering of bulk material and take into account the fact that the surface to be covered increases with the distance from the rotational center, the slit preferably widens towards the edge of the distribution plate. The slit may have parabolic shape or be Y-shaped.

A first motor is preferably provided for imparting a rotational movement to the distribution plate. Such a first motor may be arranged for rotating the central shaft and the distribution plate with respect to the spreading device. Preferably, however, the first motor is arranged between the central shaft and the distribution plate for rotating the distribution plate with respect to the central shaft.

As the bulk material is fed onto the distribution plate within the distribution trough, the area outside this distribution trough is available for fixing any connection means to the distribution plate. Indeed, the distribution plate may comprise a series of ribs directly or indirectly connected to a suspension ring arranged around the central shaft. Such connection means allow the central shaft to be disconnected from the distribution plate.

A second motor may be provided for imparting a linear movement to the at least one scraper of the scraper device. Preferably, however, a gearbox is provided for imparting such linear movement based on the rotational movement of the distribution plate, thereby removing the need for a second motor.

Advantageously, the feed pipe feeding bulk material onto the distribution plate is arranged within the central shaft. Such an arrangement allows for bulk material to be delivered onto the area corresponding to the rotational center of the distribution plate.

A heat shield is advantageously arranged underneath the distribution plate and may be directly and fixedly connected thereto. The heat shield will preferably be configured and arranged so as not to obstruct the openings created by the slit in the distribution plate. The heat shield preferably has a diameter corresponding essentially to the diameter of the circular surface to be covered by bulk material.

The linear conveyor advantageously comprises a lower portion wherein the scrapers move in a direction towards a distal wall of the distribution trough, the distal wall being arranged proximal an edge of the distribution plate; an upper portion wherein the scrapers move in a direction away from the distal wall; and a deflector plate arranged between the lower portion and the upper portion in an area underneath the feed pipe, the deflector plate being arranged so as to receive bulk material thereon and such that bulk material received on the deflector plate is entrained by the scrapers in the upper portion in a direction away from the distal wall. Such a deflector plate comprises a front edge allowing bulk material to be transferred from the deflector plate onto the distribution plate, wherein the scrapers in the lower portion are arranged such that bulk material received on the distribution plate is entrained by the scrapers in the lower portion in a direction towards the distal wall. Such an arrangement ensures that a controlled amount of bulk material is deposited onto the distribution plate and that this bulk material is spread over the entire length of the split.

The present invention also relates to a method for spreading a bulk material on a circular surface using a spreading device as described above. Such a method comprises feeding bulk material onto an area corresponding to a rotational center of the distribution plate within the distribution trough, while simultaneously imparting a rotational movement to the distribution plate and imparting a linear movement to the at least one scraper.

In order to regulate the homogeneity and/or thickness of the bulk material deposited on the circular surface, the method preferably comprises the further step of regulating rotational speed of the distribution plate and linear speed of the at least one scraper.

BRIEF DESCRIPTION OF THE DRAWINGS

A preferred embodiment of the invention will now be described, by way of example, with reference to the accompanying drawings, in which.

DESCRIPTION OF A PREFERRED EMBODIMENT

Figure 1:
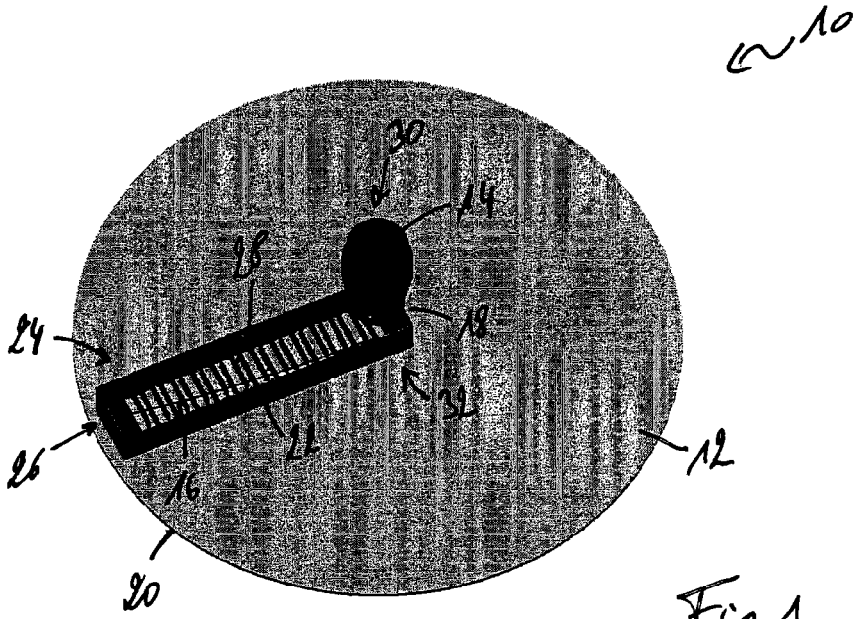
FIG. 1 is a perspective view of some of the elements of the spreading device according to the invention.

A spreading device according to the invention is herein represented as a spreading device for depositing a layer of granular material on the surface of molten metal arranged in a ladle so as to form an insulating cover on top of the molten metal.

Such a spreading device 10 comprises a distribution plate 12 rotatably mounted about a central shaft 14. The distribution plate 12 has a radius or length essentially corresponding to the inner radius of the ladle. A slit 16 is arranged in the distribution plate 12 and radially extends from the rotational center 18 of the distribution plate 12 towards the edge 20 of the distribution plate 12. The slit 16 allows for the granular material to fall through the distribution plate 12 and thus be deposited on the surface of molten metal in the ladle. The spreading device 10 further comprises a distribution trough 22 mounted on the distribution plate 12 in such a way that comprises the entire slit 16. The distribution trough 22 is essentially a rectangular box arranged on the distribution plate 12 and open at its top.

A scraper device 24 is arranged within the distribution trough 22 to move granular material fed onto a central area of the distribution plate 12 over the slit 16 radially towards the edge 20. The scraper device 24 comprises a linear conveyor 26, preferably a linear chain conveyor, having a plurality of scrapers 28 mounted thereon. Due to the plurality of scrapers 28 mounted on such a linear conveyor 26, granular material is continuously being fed from the center rotational 18 to the edge 20.

FIG. 1 also shows the central shaft 14 about which the distribution plate 12 is made to rotate. It should be noted that the central shaft 14 is hollow and serves as feed pipe 30 for the granular material. This is of particular importance as it allows granular material to be fed onto an area 32 corresponding to the rotational center of the distribution plate 12. With the slit 16 starting at the rotational center 18 of the distribution plate 12, the present spreading device 10 allows granular material to be fed to the central area of the surface of molten metal. The suspension of the distribution plate 12 on the central shaft 14 will be explained in more detail later.

Figure 2:
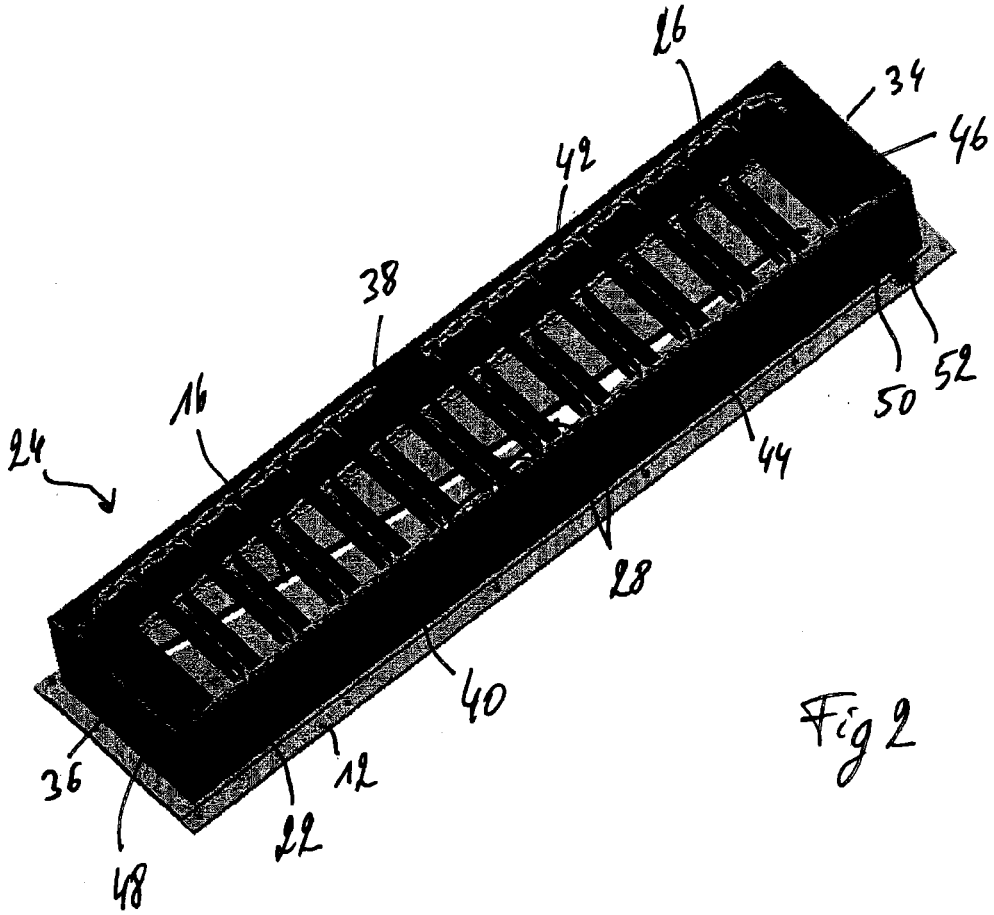
FIG. 2 is a perspective view of the distribution trough and the scraper device.

FIG. 2 is an enlarged view of the distribution trough 22 and scraper device 24 of FIG. 1. The distribution trough 22 comprises a central wall 34 and an opposite distal wall 36 and two sidewalls 38, 40 extending therebetween. The central, distal and sidewalls 34, 36, 38, 40 form a rectangular box comprising the scraper device 24 therein. The distribution trough 22 is mounted on the distribution plate 12 (of which only a portion is shown in FIG. 2) and encompasses the entire slit 16. The scraper device 24 comprises a linear conveyor 26 with two parallel chains 42, 44 mounted between two drums 46, 48 near the central and distal walls 34, 36 respectively. The drum 46 near the central wall 34 comprises a shaft 50 extending through the sidewall 40 and having a pinion 52 at its end. The pinion 52 is either connected to a motor or a gearbox (not shown) for operating said linear conveyor 26. A plurality of scrapers 28 are arranged between the two parallel chains 42, 44 and mounted so as to be essentially perpendicular to their direction of movement that is radial with respect to the distribution plate 12. The scrapers 28 have a length essentially corresponding to the distance between the two sidewalls 38, 40.

The suspension of the distribution plate 12 on the central shaft 14 can now be described in more detail later by referring to FIG. 3. The connection means comprises four connection arms 54 connected to a central body 56. The central body 56 has a funnel shaped element 58 mounted thereon, which is shaped so as to distribute the granular material over the width of the distribution trough 22. The funnel shaped element 58 is in turn connected to a suspension ring 60 for connection to the central shaft 14. The suspension ring 60, which can be seen in more detail on FIG. 4, internally comprises bearings 62 connecting to the central shaft 14. While the central shaft 14 remains stationary, the suspension ring 60, funnel shaped element 58 and central body 56 are allowed to rotate about the central shaft 14. Rotation of the central body 56 entrains the connection arms 54 and most crucially, the distribution plate 12 and the distribution trough 22 mounted thereon.

Figure 3:
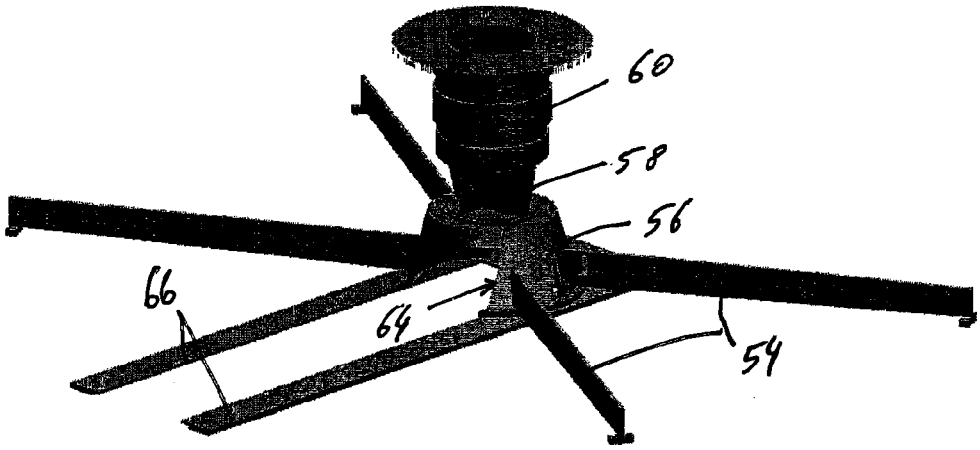
FIG. 3 is a perspective view of the connection means of the distribution plate to the central shaft.
Figure 4:
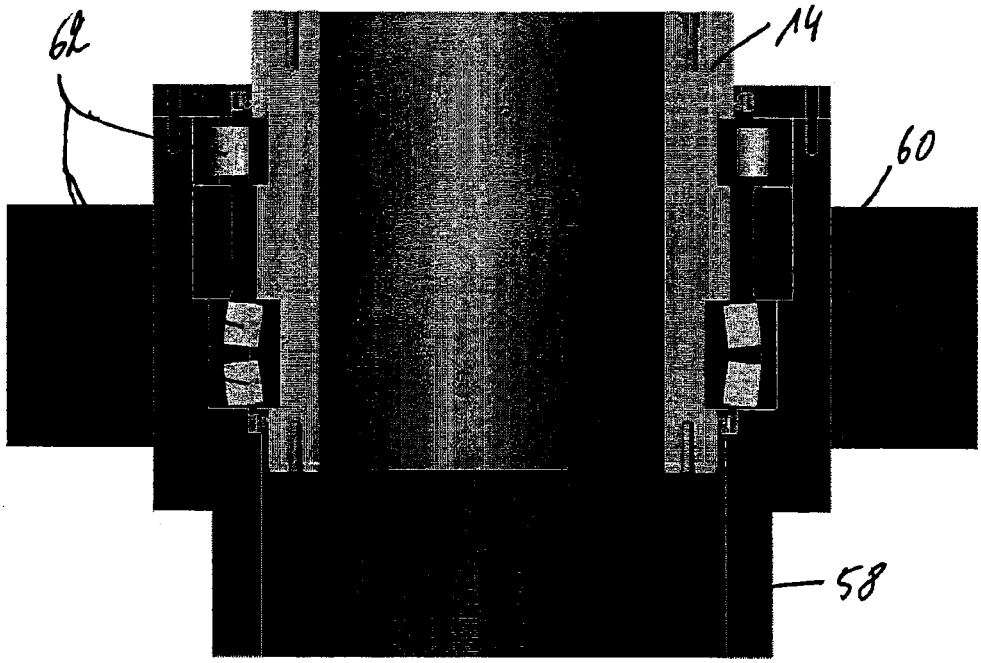
FIG. 4 is a cut through the suspension ring connecting the connection means to the central shaft.

FIG. 3 also shows an opening 64 in the central body 56 allowing the distribution trough 22 to extend into the central body 56 to reach the central area 32 of the distribution plate 12 to which the granular material is fed.

FIG. 3 further shows two support arms 66 extending outwards from said central body 56. These support arms 66 are designed and arranged to support and carry the distribution trough 22.

Figure 5:
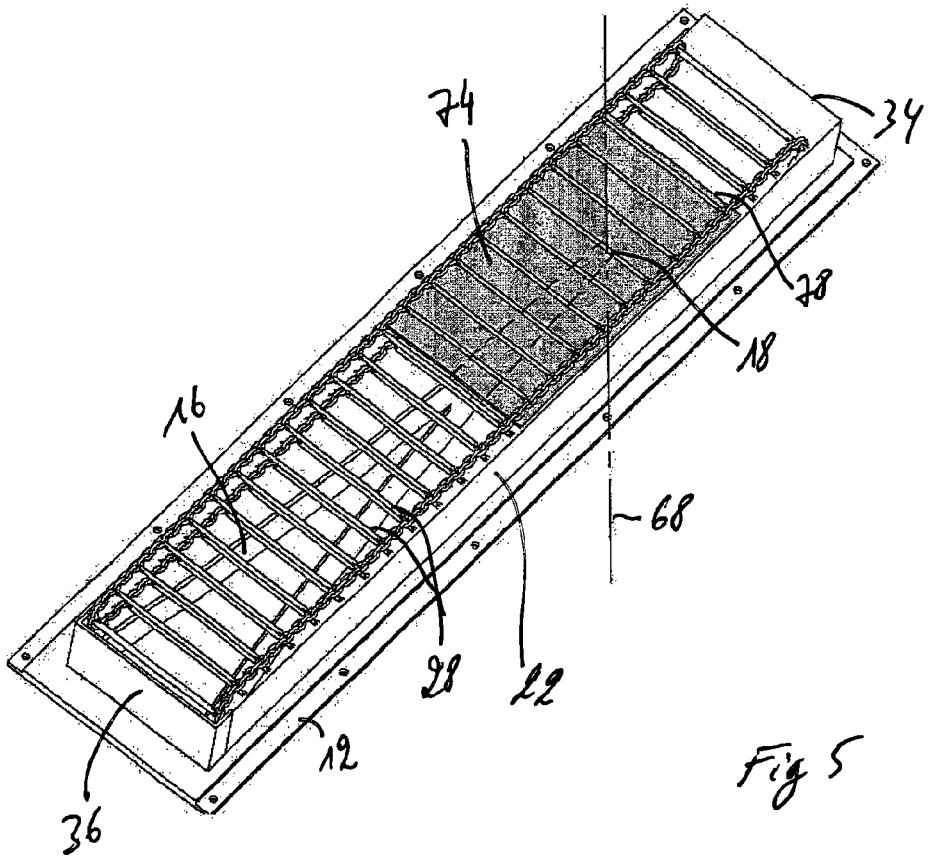
FIG. 5 is a perspective view of a preferred embodiment of the spreading device
Figure 6:
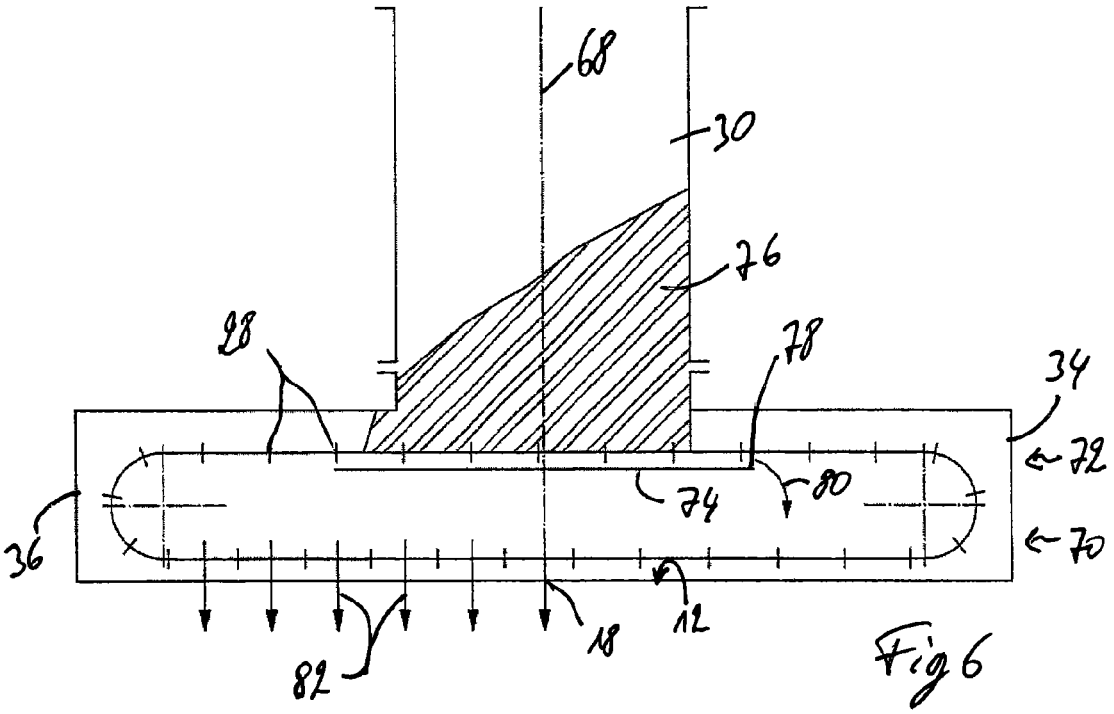
FIG. 6 is a schematic cut through the device of FIG. 5.

FIGS. 5 and 6 show a preferred embodiment of the distribution trough 22 and linear conveyor 26. The distribution trough 22 is designed to extend beyond the rotational center 18 of the distribution plate 12 (the rotational axis is indicated with reference 68) so as to extend underneath the whole cross-section of the feed pipe 30.

The linear conveyor 26 comprises a lower portion 70 and an upper portion 72. In the lower portion 70, the scrapers 28 travel over the slit 16 radially outwards towards the distal wall 36, i.e. towards the edge 20 of the distribution plate 12. In the upper portion 72, on the other hand, the scrapers 28 travel in the opposite direction towards the central wall 34. A deflector plate 74 is arranged between the upper and lower portions 70, 72 in the region underneath the feed pipe 30. Such a deflector plate 74 prevents that the granular material 76 falls directly onto the distribution plate 12 and directly into the slit 16. Instead, the granular material 76 is first received on the deflector plate 74. Due to the movement of the scrapers 28 in the upper portion 72 in a direction towards the central wall 34, the granular material 76 on the deflector plate 74 is entrained towards the central wall 34. At a front edge 78 of the deflector plate 74, the granular material 76 is then allowed to fall (as represented by arrow 80) from the deflector plate 74 onto the distribution plate 12 arranged thereunder. The granular material 76 deposited on the distribution plate 12 is subsequently entrained by the scrapers 28 in the lower portion 70 towards the distal wall 36. Due to the fact that the granular material 76 is first moved towards the central wall 34, past the rotational center 18 of the distribution plate 12, the granular material 76 is subsequently entrained over the entire slit 16, through which the granular material 76 can then be deposited (as represented by arrows 82) onto the surface of molten metal in the ladle.

The invention claimed is:

1. A spreading device for spreading of a bulk material on a circular surface, said spreading device comprising:

a distribution plate rotatably mounted about a central shaft;

at least one radially extending slit arranged in said distribution plate;

a scraper device for spreading said bulk material over a length of said slit;

a rectangular distribution trough mounted on said distribution plate, said slit being arranged within said distribution trough;

a feed pipe arranged so as to feed bulk material into said distribution trough onto an area corresponding to a rotational center of said distribution plate;

wherein said slit extends from the rotational center of said distribution plate to the edge thereof; and wherein said scraper device comprises at least one linearly displaceable scraper arranged within said distribution trough so as to feed said bulk material through said distribution trough radially outwards from said area corresponding to the rotational center of said distribution plate.

2. The spreading device according to claim 1, wherein said scraper device comprises a linear conveyor with a plurality of scrapers mounted thereon.

3. The spreading device according to claim 2, wherein said linear conveyor comprises a lower portion wherein said scrapers move in a direction towards a distal wall of said distribution trough, said distal wall being arranged proximal an edge of said distribution plate;

an upper portion wherein said scrapers move in a direction away from said distal wall;

a deflector plate arranged between said lower portion and said upper portion in an area underneath said feed pipe, said deflector plate being arranged so as to receive bulk material thereon and such that bulk material received on said deflector plate is entrained by said scrapers in said upper portion in a direction away from said distal wall;

wherein said deflector plate comprises a front edge allowing bulk material to be transferred from said deflector plate onto said distribution plate, wherein said scrapers in said lower portion are arranged such that bulk material received on said distribution plate is entrained by said scrapers in said lower portion in a direction towards said distal wall.

4. The spreading device according to claim 1, wherein said slit widens towards the edge of said distribution plate.

5. The spreading device according to claim 4, wherein said slit has parabolic shape.

6. The spreading device according to claim 4, wherein said slit is Y-shaped.

7. The spreading device according to claim 1, wherein a first motor is provided for imparting a rotational movement to said distribution plate.

8. The spreading device according to claim 7, wherein said first motor is arranged for rotating said central shaft and said distribution plate with respect to said spreading device.

9. The spreading device according to claim 7, wherein said first motor is arranged between said central shaft and said distribution plate for rotating said distribution plate with respect to said central shaft.

10. The spreading device according to claim 7, wherein a second motor is provided for imparting a linear movement to said at least one scraper of said scraper device.

11. The spreading device according to claim 7, wherein a gearbox is provided for imparting a linear movement to said at least one scraper of said scraper device based on said rotational movement of said distribution plate.

12. The spreading device according to claim 1, wherein said feed pipe is arranged within said central shaft.

13. The spreading device according to claim 1, wherein a heat shield is arranged underneath said distribution plate.

14. A method for spreading a bulk material on a circular surface, said method comprising:

providing a spreading device as claimed in claim 1;

feeding bulk material onto a central area of said distribution plate within said distribution trough, while simultaneously imparting a rotational movement to said distribution plate and imparting a linear movement to said at least one scraper.

15. The method according to claim 14, comprising the further step of regulating rotational speed of said distribution plate and linear speed of said at least one scraper.

* * * * *